US008096288B2

(12) United States Patent
Ouwenga et al.

(10) Patent No.: US 8,096,288 B2
(45) Date of Patent: Jan. 17, 2012

(54) HIGH EFFICIENCY SUPERCHARGER OUTLET

(75) Inventors: Daniel Robert Ouwenga, Battle Creek, MI (US); Matthew G. Swartzlander, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 474 days.

(21) Appl. No.: 12/246,665

(22) Filed: Oct. 7, 2008

(65) Prior Publication Data

US 2010/0086402 A1 Apr. 8, 2010

(51) Int. Cl.

| | |
|---|---|
| ***F02B 33/00*** | (2006.01) |
| ***F01C 1/18*** | (2006.01) |
| ***F01C 1/16*** | (2006.01) |
| ***F01C 1/08*** | (2006.01) |
| ***F01C 1/24*** | (2006.01) |
| ***F04C 18/00*** | (2006.01) |
| ***F04C 2/00*** | (2006.01) |

(52) U.S. Cl. ..... 123/559.1; 418/206.4; 418/201.1; 418/198

(58) Field of Classification Search ..... 418/201.1–203, 418/206.3–206.5; 123/559.1–565
See application file for complete search history.

(56) References Cited

U.S. PATENT DOCUMENTS

| | | | | |
|---|---|---|---|---|
| 1,418,741 | A | | 6/1922 | Stallman |
| 2,486,770 | A | | 11/1949 | Whitfield |
| 2,511,878 | A | | 6/1950 | Rathman |
| 2,622,787 | A | | 12/1952 | Nilsson |
| 2,667,046 | A | * | 1/1954 | Densham ..... 418/206.4 |
| 3,073,514 | A | | 1/1963 | Bailey et al. |
| 3,245,612 | A | | 4/1966 | Nilsson et al. |
| 3,746,482 | A | | 7/1973 | Luthi |
| 3,885,402 | A | | 5/1975 | Moody, Jr. et al. |
| 3,977,818 | A | * | 8/1976 | Sprankle ..... 418/201.2 |
| 4,025,244 | A | * | 5/1977 | Sato ..... 418/87 |
| 4,062,199 | A | | 12/1977 | Kasahara et al. |
| 4,210,410 | A | * | 7/1980 | Ohtani ..... 418/201.3 |
| 4,388,048 | A | * | 6/1983 | Shaw et al. ..... 417/310 |
| 4,548,549 | A | * | 10/1985 | Murphy et al. ..... 417/53 |
| 4,553,911 | A | | 11/1985 | Pillis |
| 4,575,323 | A | * | 3/1986 | Yoshimura ..... 418/201.2 |
| 4,842,501 | A | * | 6/1989 | Schibbye et al. ..... 418/201.2 |
| 4,859,158 | A | * | 8/1989 | Weinbrecht ..... 418/206.4 |
| 5,090,879 | A | * | 2/1992 | Weinbrecht ..... 418/206.4 |
| 5,118,268 | A | * | 6/1992 | Crisenbery et al. ..... 418/206.4 |
| 5,123,821 | A | * | 6/1992 | Willibald et al. ..... 418/197 |
| 5,131,829 | A | * | 7/1992 | Hampton ..... 418/189 |
| 5,195,881 | A | * | 3/1993 | George, Jr. ..... 418/97 |
| 5,468,132 | A | * | 11/1995 | Snell et al. ..... 418/206.4 |
| 5,527,168 | A | | 6/1996 | Juday |

(Continued)

FOREIGN PATENT DOCUMENTS

| | | |
|---|---|---|
| JP | 8177504 | 7/1996 |

(Continued)

*Primary Examiner* — Thai Ba Trieu
(74) *Attorney, Agent, or Firm* — Dykema Gossett PLLC

(57) ABSTRACT

A supercharger is provided that includes a housing having a first end and a second end. The housing may at least partially define a chamber and may include at least one rotor disposed within the chamber. The supercharger includes an inlet port proximate the first end of the housing and an outlet port proximate the second end of the housing. The supercharger further includes a relief chamber in fluid communication with the chamber. In an embodiment, the relief chamber may extend in the axial direction and may have a depth in the axial direction that is equal to at least about 10% of the axial length of the rotor.

16 Claims, 5 Drawing Sheets

U.S. PATENT DOCUMENTS 5,662,463 A * 9/1997 Mirzoev et al. ..... 418/73
6,210,138 B1 * 4/2001 Cortez ..... 418/132
6,422,846 B1 * 7/2002 Zhong et al. ..... 418/197
6,758,661 B1 7/2004 Thelen
7,008,201 B2 3/2006 Heizer
7,052,259 B2 5/2006 Nachi
7,488,164 B2 * 2/2009 Swartzlander ..... 418/196
7,866,966 B2 * 1/2011 Swartzlander ..... 418/206.5
2002/0037230 A1 * 3/2002 Sjoholm et al. ..... 418/201.2
2005/0223734 A1 10/2005 Smith et al.
2006/0196184 A1 9/2006 Sprankle

FOREIGN PATENT DOCUMENTS

JP 2000337283 A * 12/2000

* cited by examiner

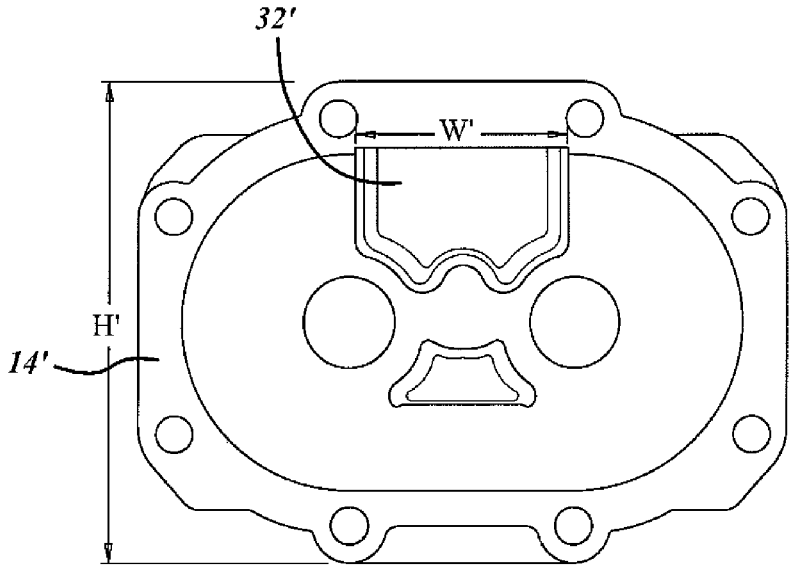
PRIOR ART
FIG. 7A
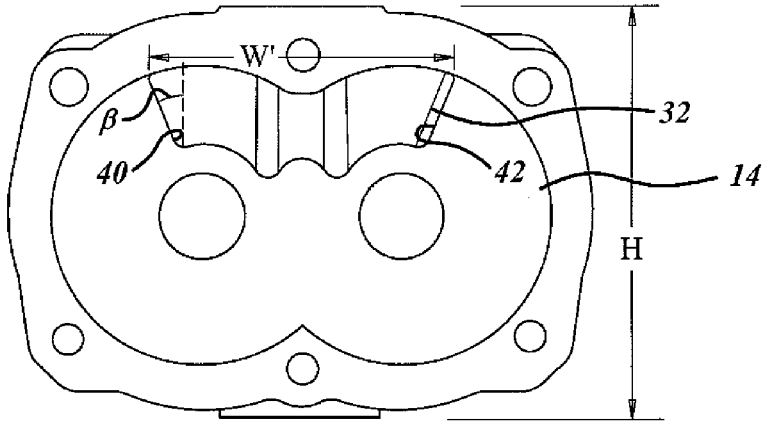
FIG. 7B
| | | ISENTROPIC EFFICIENCY | |
|---|---|---|---|
| SC ROTOR (RPM) | Pressure Ratio | R900 W/ STD OUTLET(%) | R570 W/ UPDATED OULET(%) |
| 10000 | 1.6 | 74.8 | 74.3 |
| 18000 | 1.6 | 66.6 | 73.5 |
FIG. 10

HIGH EFFICIENCY SUPERCHARGER OUTLET

TECHNICAL FIELD

The present invention relates to a positive displacement air pump employed as a supercharger for an internal combustion engine, including a positive displacement air pump employed as a supercharger and having a modified outlet port to improve isentropic efficiency.

BACKGROUND

Positive displacement air pumps include Roots-type blowers, screw-type air pumps, and many other similar devices with parallel lobed rotors. Positive displacement air pumps may include lobed rotors having either straight lobes or lobes with a helical twist. The rotors may be meshingly disposed in parallel, transversely overlapping cylindrical chambers defined by a housing. Each rotor may have four lobes in conventional embodiments, although each rotor may have fewer or more lobes in other embodiments. Spaces between adjacent unmeshed lobes of each rotor may transfer volumes of compressible fluid (e.g., air) from an inlet port to an outlet port opening, with or without mechanical compression of the fluid in each space prior to exposure of the transfer volumes to the outlet port opening. The ends of the unmeshed lobes of each rotor may be closely spaced from the inner surfaces of the cylindrical chambers to effect a sealing cooperation therebetween. As the rotor lobes move out of mesh, air may flow into volumes or spaces defined by adjacent lobes on each rotor. The air in these volumes may be trapped therein at substantially inlet pressure when the meshing lobes of each transfer volume move into a sealing relationship with the inner surfaces of the cylindrical chambers. Timing gears may be used to maintain the meshing lobes in closely spaced, non-contacting relation to form a seal between the inlet port and outlet port opening. The volumes of air may transferred or directly exposed to the outlet port when the lobes move out of sealing relationship with the inner surfaces of the cylindrical chambers.

Conventionally, positive displacement air pumps may be used as superchargers for vehicle engines, wherein the engine provides the mechanical torque input to drive the lobed rotors. The volumes of air transferred to the outlet port may be utilized to provide a pressure "boost" within the intake manifold of the vehicle engine, in a manner that is well known to those of ordinary skill in the art. The power or energy required to transfer a particular volume of air under certain operating conditions may be used in evaluating the efficiency of a positive displacement air pump. To pump the fluid (e.g., air) using a supercharger requires that mechanical energy be placed into the supercharger. The required mechanical energy input is directly related to the various efficiencies (e.g., mechanical, isentropic, etc.) and operating conditions of the supercharger (e.g., mass flow rate, pressure ratio, etc.). For the same operating conditions, if the efficiency is improved, the required mechanical energy input is decreased, thus benefiting efficiency of the overall system that the supercharger is applied to (e.g., an internal combustion engine). An ideal process would be 100% efficient. However, actual compression will operate at an efficiency below this level. The actual compression relative to the ideal process is called isentropic efficiency. The temperature of the air being transferred may increase as the air flows through the supercharger. By improving isentropic efficiency, less excessive heat energy may be put into the fluid (e.g., air) to achieve the desired pressure for the fluid (e.g., air).

Previous attempts have been made to improve the isentropic efficiency of positive displacement air pumps, such as Roots-type blowers, by improving the configuration of the outlet port. For example, the outlet port of a Roots-type blower may be configured as disclosed and illustrated in U.S. Pat. No. 5,527,168, which is hereby incorporated by reference in its entirety. As technological improvements have been made to supercharger rotor geometry (including, for example, the degree of helical twist), the fluid velocity has been shifted more towards the axial direction, as opposed to the radial direction. However, current parallel shaft supercharger outlet port geometry may continue to account mainly for radial outlet airflow, rather than significantly addressing the axial flow component of the fluid velocity.

It may be desirable to optimize flow geometry at the outlet end of the supercharger to better account for both the axial and radial fluid velocity, while still maintaining the conventional and/or standard features of a supercharger, such as an axial inlet direction and a radial outlet port direction. As supercharger speed increases, the axial velocity component may also increase and may require a more drastic velocity change as it exits the outlet port of a conventional supercharger design. In particular, all axial velocity vectors may be required to be converted into radial velocity vectors, thereby increasing the work that must be performed on the fluid.

SUMMARY

A supercharger is provided that may include a housing having a first end and a second end. The housing may at least partially define a chamber and may include at least one rotor disposed within the chamber. The supercharger may further include an inlet port proximate the first end of the housing and in fluid communication with the chamber and an outlet port proximate the second end of the housing and in fluid communication with the chamber. The supercharger may further include a relief chamber in fluid communication with the chamber. In an embodiment, the relief chamber may extend in the axial direction and may have a depth in the axial direction that is equal to at least about 10% of the axial length of the rotor.

An improved outlet port geometry for a supercharger in accordance with an embodiment of the present invention may allow for retaining the standard or conventional features of a supercharger, including an axial inlet and a radial outlet, while decreasing the excess work performed on the fluid. An improved outlet port geometry may be used to generate an optimal flow path for the fluid as it exits the supercharger. An improved outlet port geometry for a supercharger be especially useful for improving performance in the high flow and/or high speed portion of the supercharger operating range. By increasing performance in the high flow and/or high speed portion of the operating range, a smaller supercharger may be used to achieve increased performance. The utilization of a smaller supercharger may significantly decrease packaging size requirements and costs.

BRIEF DESCRIPTION OF THE DRAWINGS

Embodiments of the invention will now be described, by way of example, with reference to the accompanying drawings, wherein:

FIG. 7A is a top plan view of a prior art bearing plate including a prior art relief chamber;

FIG. 7B is a top plan view of a bearing plate including a relief chamber according to an embodiment of the present invention;

FIG. 10 is a chart of isentropic efficiency versus supercharger speed, comparing the prior art device with the present invention.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as embodied by the appended claims.

Figure 1:
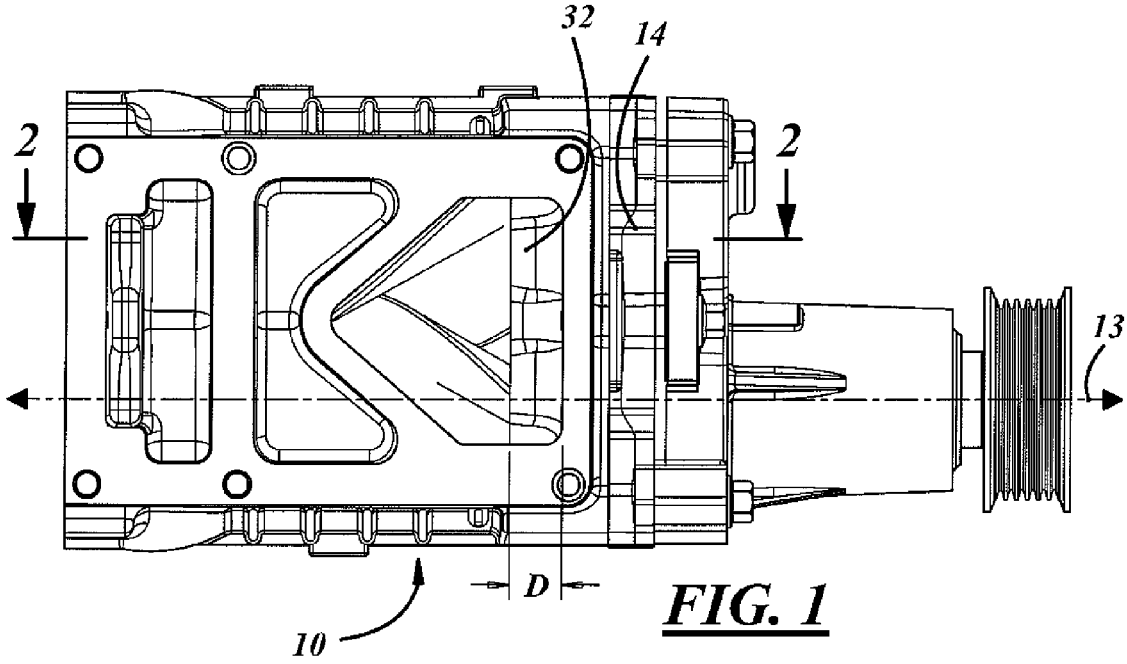
FIG. 1 is view of a supercharger according to an embodiment of the present invention.
Figure 2:
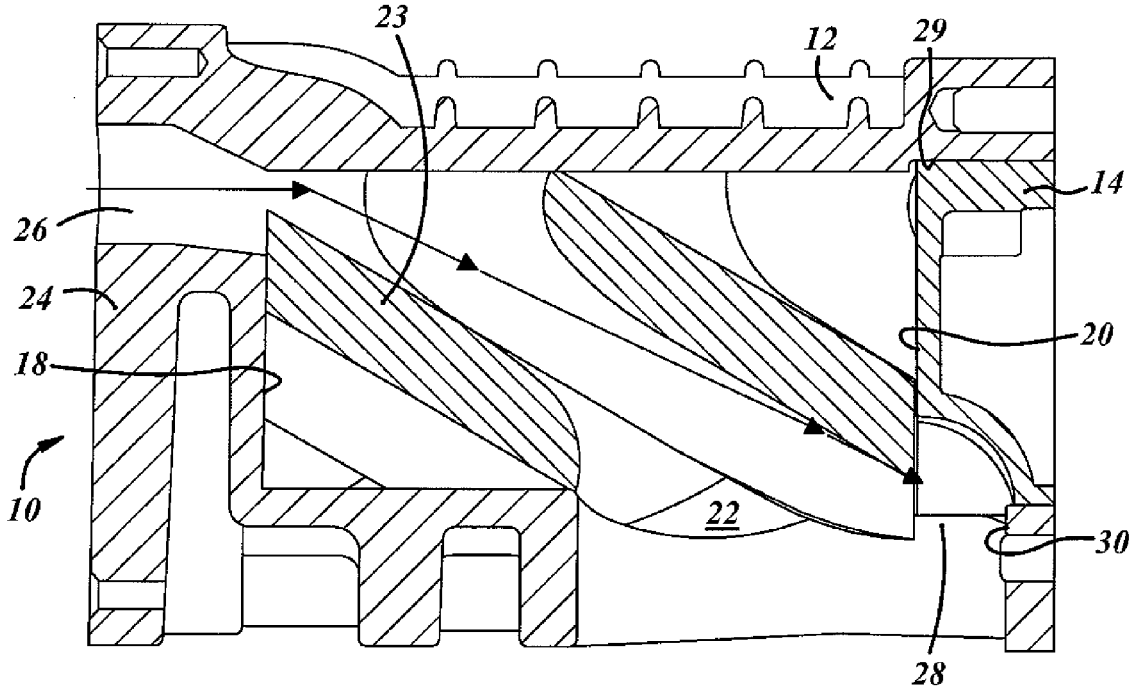
FIG. 2 is a cross-sectional view of a portion of a supercharger according to an embodiment of the present invention.
Figure 3:
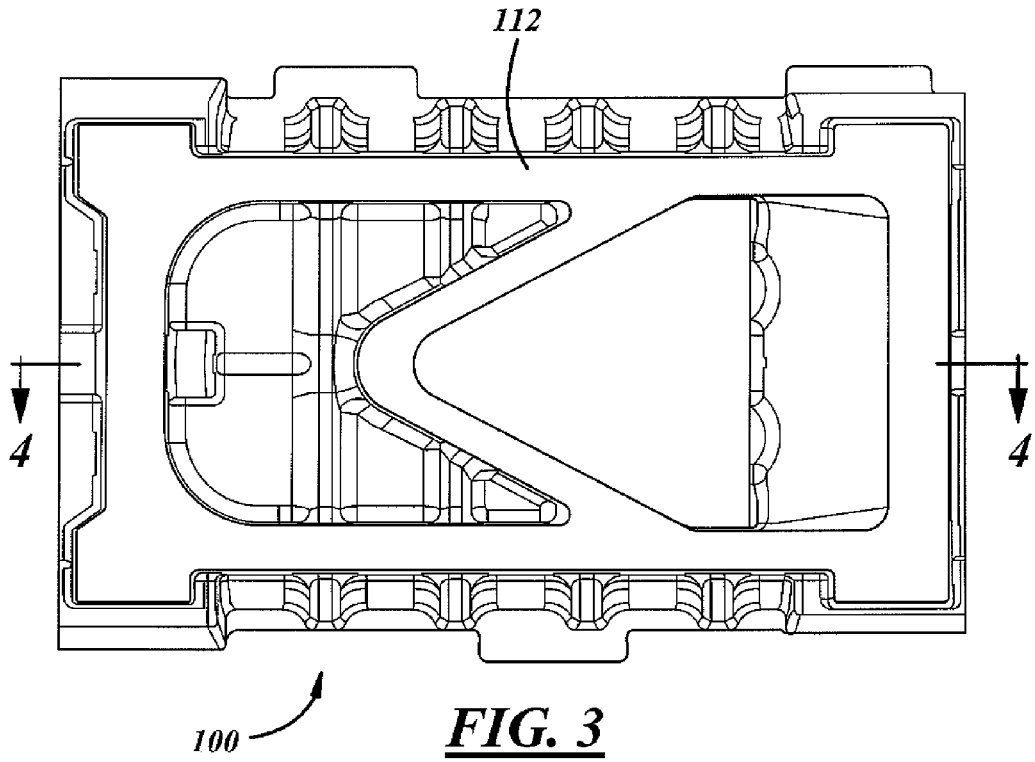
FIG. 3 is a view of a supercharger according to an embodiment of the present invention.
Figure 4:
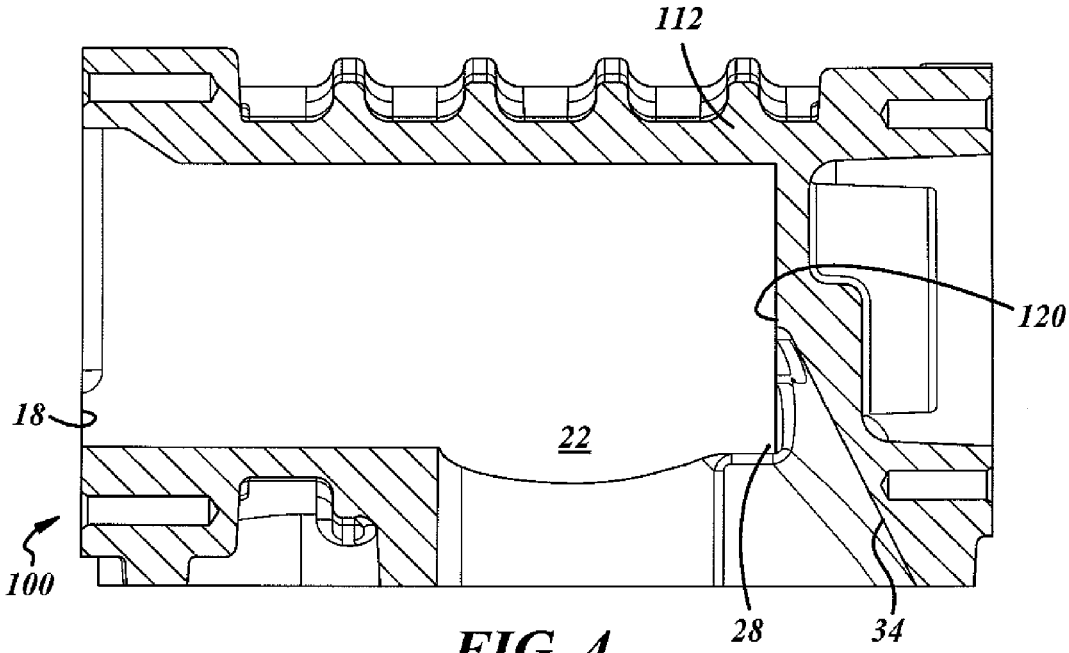
FIG. 4 is a cross-sectional view of a portion of a supercharger according to an embodiment of the present invention.

Referring now to FIGS. 1-2, the supercharger (e.g., positive displacement air pump) 10 may include a main housing 12 and a bearing plate 14. The supercharger 10 may include a longitudinal axis 13. The main housing 12 and bearing plate 14 may be secured together in any manner known to those of ordinary skill in the art. For example, the housing 12 and bearing plate 14 may be secured together by a plurality of machine screws (not shown) with the appropriate alignment being insured by means of a pair of dowel pins (not shown). Although the main housing 12 and bearing plate 14 have been described as comprising separate members, this may not be the case in other embodiments and they may be integral and/or unitary members in other embodiments. For example and without limitation, the housing and bearing plate may form an integral and/or unitary and/or monolithic structure. When the housing and bearing plate are integrated, the outlet geometry for the supercharger would be the same as described herein, but the supercharger would comprise one component, rather than two components. For example and without limitation, referring now to FIGS. 3-4, the supercharger 100 is shown as having an integrated housing and bearing plate design 112.

While the positive displacement air pump or supercharger 10, 100 may comprise a Roots-type blower or a screw-type air pump in some embodiments, the positive displacement air pump 10, 100 may comprise any type of positive displacement air pump with rotors (e.g., lobed rotors) in other embodiments. For example, the positive displacement air pump 10, 100 may comprise any air pump with parallel lobed rotors.

The main housing 12, 112 may be a unitary member defining inner cylindrical wall surfaces and a transverse end wall 18. The bearing plate 14 may define a bearing plate end wall 20 in some embodiments. In other embodiments, a separate bearing plate may not be utilized. Instead, a single component serving the function of the housing and bearing plate may be utilized, and the single component may define an end wall 120 opposite the transverse end wall 18. The inner cylindrical wall surfaces of main housing 12 and the end walls 18, 20 or 120 (of the housing 12 or the housing and bearing plate structure 112, for example) may together define a plurality of transversely overlapping cylindrical chambers 22. In an embodiment, there may be two overlapping cylindrical chambers 22.

A plurality of rotors 23 may be disposed within the overlapping cylindrical chambers 22. Each of the rotors 23 may have four lobes. Although four lobes are mentioned in detail, each of the rotors 23 may have fewer or more lobes in other embodiments. Each of the rotors 23 may be mounted on a rotor shaft for rotation therewith. Each end of each rotor shaft may be rotatingly supported within the bearing plate 14 or a single component housing by means of a bearing set (not shown). At least one of the rotors 23 may utilize any of various input drive configurations (an input shaft portion and/or step up gear set, for example and without limitation) by means of which the supercharger 10 may receive input drive torque.

Figure 5:
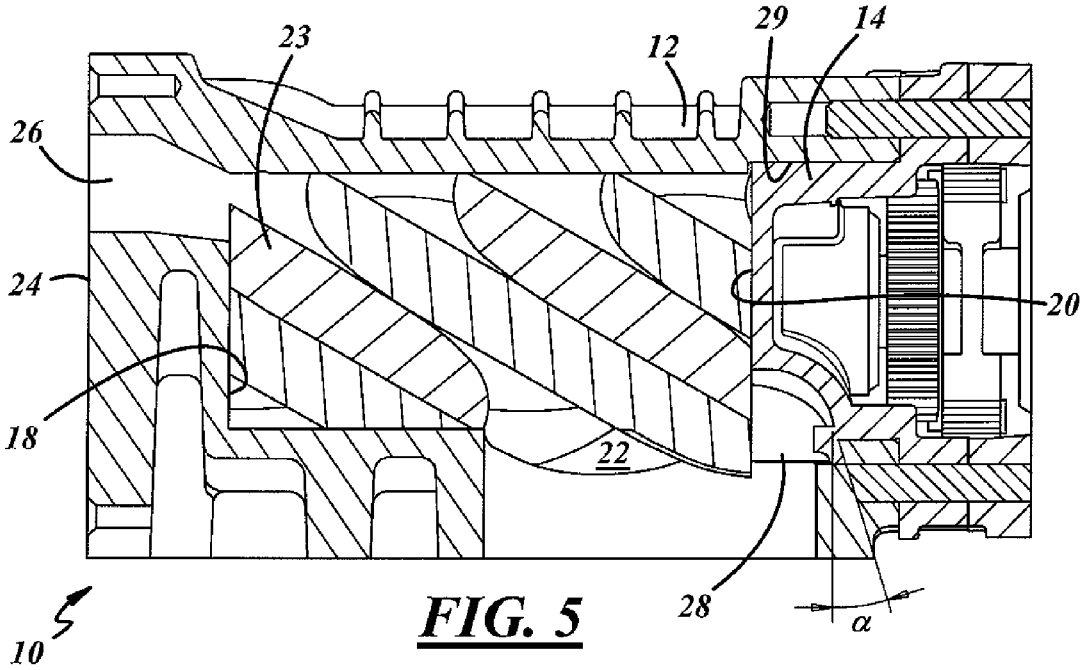
FIG. 5 is a cross-sectional view of a portion of a supercharger according to an embodiment of the present invention.

Main housing 12, 112 may include a first end a second end. The first end of main housing 12, 112 may include a backplate portion 24. Backplate portion 24 may be formed integrally with main housing 12 in some embodiments, or may comprise a separate plate member in other embodiments. Backplate portion 24, whether integral with or separate from the housing 12, 112, may define an inlet port 26. The inlet port 26 may be in fluid communication with at least one of the chambers 22 in which the rotors 23 are disposed. Main housing 12, 112 may also define an outlet port 28. The outlet port 28 may be proximate the second end of main housing 12, 112. The outlet port 28 may also be in fluid communication with at least one of the chambers 22 in which the rotors 23 are disposed. The outlet port 28 may include a port end surface 30 and a pair of oppositely disposed port side surfaces (not shown). The port end surface 30 may be substantially perpendicular to the longitudinal axis 13 of supercharger 10 in an embodiment as shown in FIG. 2. However, the port end surface 30 may be angled in other embodiments (e.g., not substantially perpendicular to the longitudinal axis 13 of supercharger 10). For example, as shown in FIG. 5, the port end surface may be angled outwardly by an angle $\alpha$. Angle $\alpha$ may be less than 45° in an embodiment. Although angle $\alpha$ specifically mentioned as being less than 45° angle $\alpha$ may be larger or smaller in other embodiments.

The main housing 12 may include an end portion 29 in some embodiments, which may function as a receiving portion for the bearing plate 14. The end portion 29 may be proximate the second end of main housing 12. In other embodiments, a separate bearing plate may not be utilized and housing 112 may include an integral bearing plate structure at the second end of the housing 112. In these other embodiments where the bearing plate structure is integral with the housing 112, a receiving portion for a bearing plate in the housing 112 may not be necessary.

Figure 6:
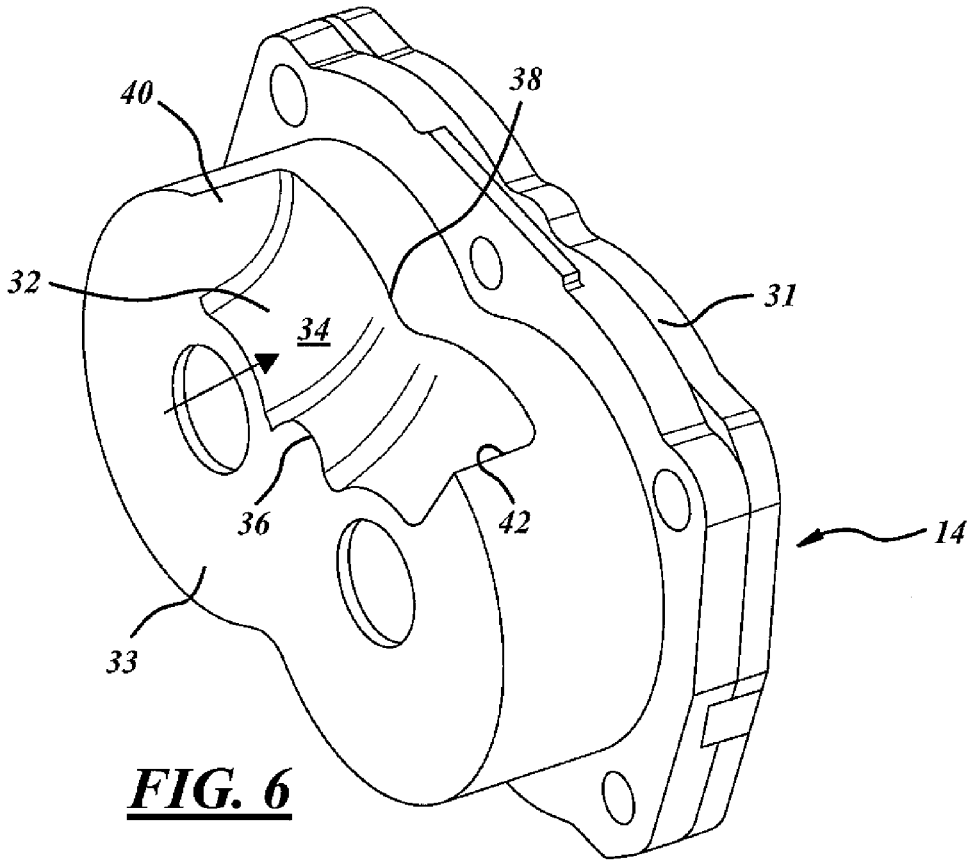
FIG. 6 is a perspective view of a bearing plate according to an embodiment of the present invention.

Referring now to FIG. 6, a bearing plate 14 may be provided to enable assembly of the supercharger 10. However, as described herein, a bearing plate 14 may be omitted in other embodiments of the invention (e.g., FIGS. 3-4). For example, in other embodiments of the invention, the structure of the bearing plate may be integrated with the housing 112. In accordance with an embodiment of the invention in which a separate bearing plate 14 may be utilized, the bearing plate 14 may comprise a first portion 31 and a second portion 33. The first portion 31 may be connected to and/or integral with the second portion 33. The first portion 31 may be of an approximately rectangular-type shape and may have a certain thickness that is constant. The first portion 31 of the bearing plate 14 may include a plurality of apertures for receiving a plurality of fasteners to connect the bearing plate 14 to the main housing 12. The second portion 33 of the bearing plate may be of an approximately dumbbell-type shape and may have a certain thickness that is generally greater than that of the first portion 31.

The second portion 33 of the bearing plate 14 may include and/or define a relief chamber 32. The relief chamber 32 may be provided to assist in reducing drive horse power and increasing isentropic efficiency. In particular, a portion of the fluid that is being transferred from the inlet port 26 to the outlet port opening 28 may exit axially from the end of the rotors (as opposed to that portion of the fluid which may exit radially). The region of the supercharger 10 in which the fluid may exit axially from the end of the rotors may be coextensive with the relief chamber 32. The relief chamber 32 may include and/or be defined in part by a chamber end surface 34. The relief chamber 32 may face inwardly toward the overlapping cylindrical chamber 22 in which the rotor 23 is disposed. The relief chamber 32 may be in fluid communication with the cylindrical chamber 22 in which the rotor 23 is disposed. The relief chamber 32 may extend in the axial direction and may extend beyond cylindrical chamber 22 in the axial direction toward the second end of the housing 12.

Although the relief chamber 32 is described and shown in detail as being formed and/or placed in a bearing plate 14, the relief chamber 32 may also be formed in other structures in other embodiments of the invention. For example, the relief chamber 32 may be formed in an integral portion of the housing 112 in another embodiment. The relief chamber 32 may also be formed in any other suitable structure at the second end of the housing that opposes the first end including inlet 26 in other embodiments. This structure may be integral with and/or separate from the housing 12. In these embodiments that do not include separate bearing plate 14, the function of the relief chamber 32 may be substantially the same as when the relief chamber is included in the bearing plate 14 and the geometries of the outlet port 28 may be substantially the same as when the relief chamber is included in the bearing plate 14.

The chamber end surface 34 may be substantially curved (e.g., sloping upward) from a front edge 36 to a back edge 38. In other embodiments, the chamber end surface 34 may have substantially less of a curved geometry (see, e.g., FIG. 4), but the relief chamber 32 may still be configured to function substantially the same. In some embodiments, the chamber end surface 34 may be in a plane generally perpendicular to the bearing plate 14 near the front edge 36. The chamber end surface 34 may be in a plane generally parallel to the bearing plate 14 near the back edge 38. The front edge 36 may include a plurality of curves and indentations. For example, the front edge 36 may include at least three curves with two indentations disposed therebetween in an embodiment. Although three curves and two indentations are mentioned in detail, the front edge 36 may include fewer or more curves and/or indentations in other embodiments. The curves and indentions in the front edge 36 may also define the chamber end surface 34, such that at least a portion of the chamber end surface 34 may have a substantially corresponding number of bumps and valleys. The front edge 36 may be straight in other embodiments of the invention. In at least some embodiments, the front edge 36 may be configured to substantially correspond in size and/or shape to the size and/or shape of the lobed rotors disposed within the overlapping, cylindrical chambers 22 of the housing 12. The back edge 38 of the relief chamber 32 may include a plurality of curves and an indentation. For example, the back edge 38 may include at least two curves in an embodiment with an indentation disposed therebetween. Although two curves and a single indentation are mentioned in detail, the back edge 38 may include fewer or more curves and/or indentations in other embodiments. Although the back edge 38 may include one or more curves and/or indentations, the chamber end surface 34 near the back edge 38 may be flat. The back edge 38 may be straight in other embodiments of the invention.

The relief chamber 32 may also be defined by a pair of oppositely disposed chamber side surfaces 40, 42. Each of the chamber side surfaces 40, 42 may be angled outwardly from the relief chamber 32 in an embodiment. For example, as best shown in FIG. 7B, the chamber side surfaces 40, 42 may be angled at β degrees. The angle β may be approximately 22° in accordance with an embodiment. The angle β may range from about 10° to about 40° in some embodiments. Although these angles are mentioned in detail, the angle β may be greater or smaller in other embodiments. In other embodiments, each of the chamber side surfaces 40, 42 may not be substantially linear as illustrated. For example and without limitation, the chamber side surfaces 40, 42 may be substantially curved. The chamber side surfaces 40, 42 may be configured to substantially correspond in geometry to the geometry of the lobes of the rotors disposed within supercharger 10, 110.

Figure 8:
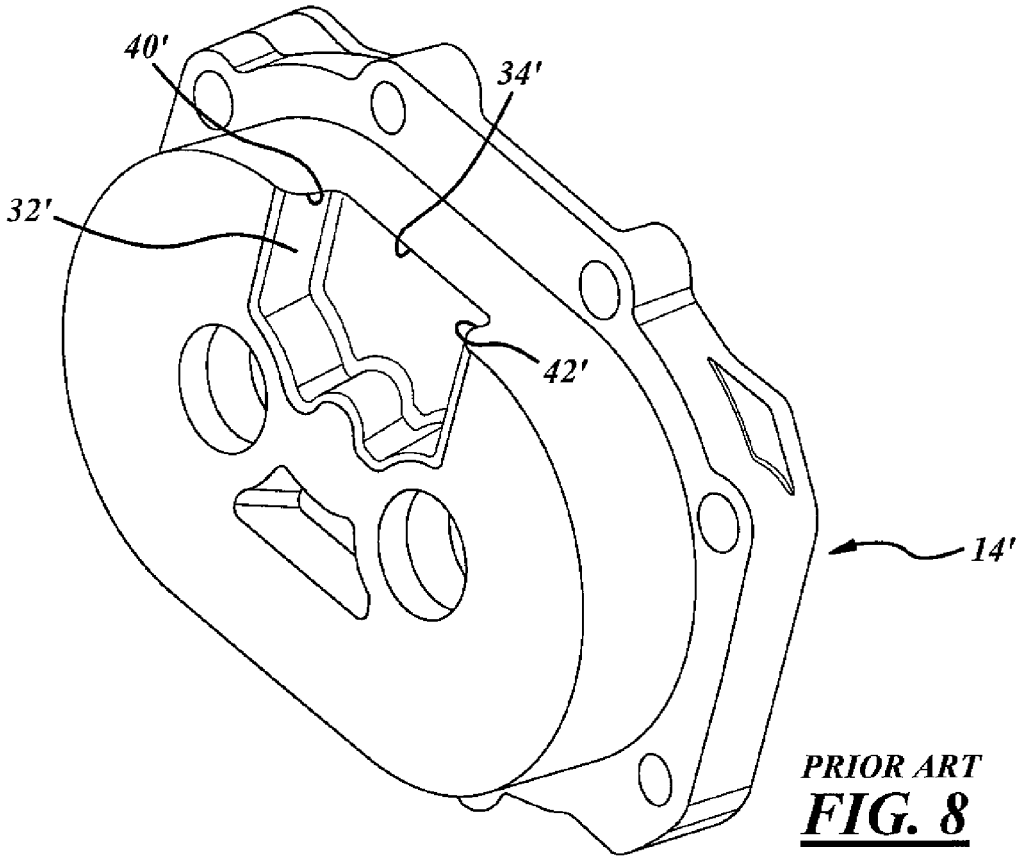
PRIOR ART FIG. 8
FIG. 8 is a perspective view of a prior art bearing plate including a prior art relief chamber.
Figure 9A:
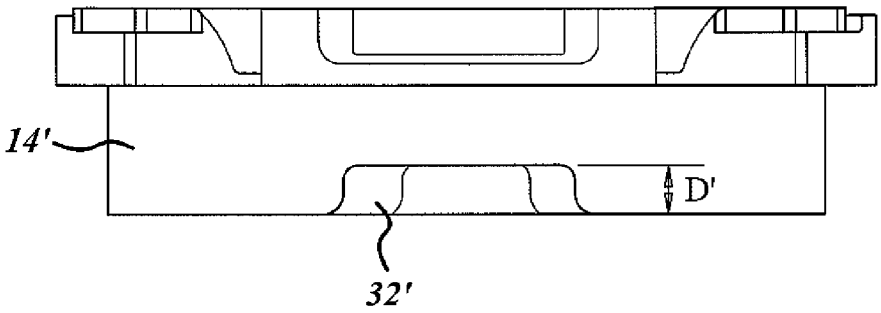
PRIOR ART FIG. 9A
FIG. 9A is a front view of a prior art bearing plate including a prior art relief chamber.
Figure 9B:
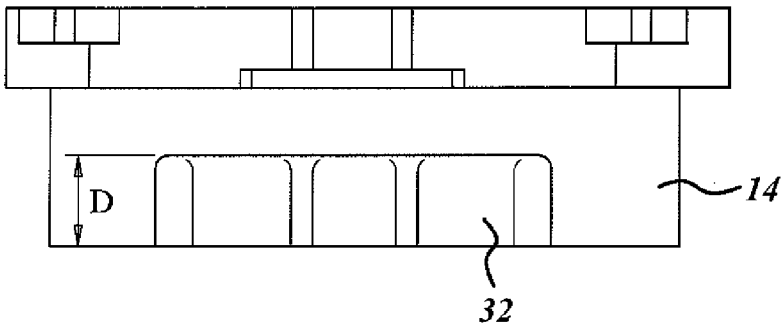
FIG. 9B is a front view of a bearing plate including a relief chamber according to an embodiment of the present invention.

Referring now to FIG. 8, a prior art bearing plate 14' including and/or defining a relief chamber 32' is shown. The relief chamber 32' may be defined by a chamber end surface 34' and a pair of oppositely disposed chamber side surfaces 40', 42'. Referring now to FIG. 9A-9B, a difference between the prior art relief chamber 32' and the relief chamber 32 of the present invention may be illustrated. In particular, the depth D of the relief chamber 32 in the axial flow direction may be increased in accordance with the present invention. The depth D of the relief chamber 32 in the axial flow direction may substantially correspond and/or relate to supercharger displacement, rotor size, and/or rotor length. In accordance with an embodiment of the invention, the depth D of the relief chamber 32 may be approximately equal to at least 10% of the supercharger rotor length. In some embodiments, the depth D of the relief chamber 32 may approximately equal to about 10% to about 35% of the supercharger rotor length. For example and without limitation, the relief chamber 32 of the bearing plate 14 may have a depth D of about 20 mm. In accordance with some embodiments of the invention, the relief chamber 32 may have a depth D that is about twice as deep than the depth D' of the prior art relief chamber 32'. The depth D may be greater or smaller in other embodiments, in particular depending upon the rotor size, rotor length, and/or supercharger displacement. Although certain percentages of the supercharger rotor length are mentioned in detail, the depth D of the relief chamber 32 may be a smaller or larger percentage of supercharger rotor length in other embodiments. Although certain depths may be mentioned in detail, the depth D of the relief chamber 32 may be greater or smaller in other embodiments.

Referring again to FIG. 7A-7B, another difference between the prior art relief chamber 32' and the relief chamber 32 of the present invention may be illustrated. In particular, the width of the relief chamber may be increased in bearing plate 14 of the present invention. For example and without limitation, the relief chamber 32 may have a width W that is equal to at least about 50% of the width of the chamber 22 in which the rotor 23 is disposed. For another example, the relief chamber 32 may have a width W that is about 50% wider than the width W' of relief chamber 32'. The width W may be greater or smaller in other embodiments. The width W of the relief chamber 32 may be configured to substantially correspond in geometry to the geometry of the lobes of the rotors disposed within supercharger 10.

Still referring to FIGS. 7A-7B, another difference between the prior art bearing plate 14' and the bearing plate 14 of the present invention is illustrated. For example and without limitation, the bearing plate 14 may be smaller in height H than the height H' of the prior art bearing plate 14'. Furthermore, the number of fasteners necessary to secure the bearing plate 14 to main housing 12 in an embodiment of the invention may be reduced. For example and without limitation, approximately six fasteners may be used to secure bearing plate 14 to main housing 12, whereas conventional bearing plates 14' may use at least eight fasteners. Although these numbers of fasteners are mentioned in detail, fewer or more fasteners may be used in other embodiments. Reductions in the size of the bearing plate 14 for the supercharger 10 result in decreases in package size and cost, while maintaining the same amount of fluid flow.

Referring now primarily to FIG. 10, a chart of isentropic efficiency versus supercharger speed, comparing the prior art device (e.g., having a relief chamber 32' as shown in FIG. 8) with the present invention (e.g., having a relief chamber 32 as shown in FIG. 6), is illustrated. The testing which led to the chart of FIG. 10 was performed on a pair of Roots-type blower superchargers operated at the same pressure and may provide information regarding the isentropic efficiency (as a percent) versus supercharger speed (e.g., the speed of the input drive mechanism and/or configuration). The isentropic efficiency of a device is the actual performance of the device (e.g., work output) as a percent of that which would be achieved under theoretically ideal circumstances (i.e., if no heat loss occurred in the system). In other words, in the case of a supercharger, the isentropic efficiency is an indication of the amount of input energy being wasted as heat.

As may be seen in FIG. 10, the invention and the prior art are both about 74% efficient at a medium supercharger speed of about 10000 RPM. However, when the supercharger speed is increased to about 18000 RPM, the prior art device with the conventional outlet utilizing relief chamber 32' has dropped to about 67% efficiency, while the device of the present invention with the improved relief chamber 32 is still around 73% efficient. Accordingly, the prior art device is only about 89% as efficient at high supercharger speeds as the prior art device is at medium supercharger speeds. On the other hand, the device of the present invention is still about 98% as efficient at high supercharger speeds as the device of the present invention is at medium supercharger speeds. In an embodiment, the isentropic efficiency of the supercharger at about 18000 RPM may be at least about 95% of the isentropic efficiency of the supercharger at about 10000 RPM. The device of the present invention is substantially more efficient than the prior art device at high blower speeds (e.g., about 18000 RPM), which is the situation where isentropic efficiency is of greatest concern. The device of the present invention utilizing improved relief chamber 32 also maintains about the same isentropic efficiency at medium blower speeds (e.g., about 10000 RPM) as the prior art device utilizing relief chamber 32' does at the same blower speeds. The improved outlet utilizing relief chamber 32 also does not decrease flow.

Although the efficiency of the present invention may be at least about 70% efficient at about 18000 RPM at certain pressure ratios (e.g., a pressure ratio of 1.6 as illustrated in FIG. 10), the efficiency of the present invention may increase or decrease depending upon the pressure ratio and/or mass flow (kg/hr) for the supercharger. Accordingly, the efficiency may be higher or lower than 70% at high supercharger speeds under other conditions. However, the isentropic efficiency (%) of a supercharger with an improved outlet utilizing relief chamber 32 may generally be greater than the isentropic efficiency (%) of a supercharger with an outlet utilizing prior art relief chamber 32' at higher supercharger speeds, even at different pressure ratios and mass flow rates.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims. It is intended that the scope of the invention be defined by the claims appended hereto and their equivalents.

What is claimed:

1. A supercharger having a longitudinal axis, comprising:

a housing at least partially defining a chamber, the housing having a first end and a second end;

at least one rotor disposed within the chamber;

an inlet port proximate the first end of the housing and in fluid communication with the chamber;

an outlet port proximate the second end of the housing and in fluid communication with the chamber, wherein at least a section of the outlet port is located at the same longitudinal position as a portion of the rotor and is configured to allow fluid to directly exit the chamber in a radial direction; and a relief chamber in fluid communication with the chamber, the relief chamber including a chamber end surface and a pair of oppositely disposed chamber side surfaces defining the entire width of the relief chamber, wherein the relief chamber has a depth in the axial direction that is equal to at least about 10% of the axial length of the rotor and is configured to allow fluid to exit the chamber in an axial direction, and wherein the chamber end surface is substantially curved from a front edge to a back edge and each of the chamber side surfaces is angled outwardly from the relief chamber.

2. The supercharger according to claim 1, further comprising a bearing plate connected to the housing at the second end of the housing, wherein the relief chamber is included in the bearing plate.

3. The supercharger according to claim 1, wherein the relief chamber is included in the housing.

4. The supercharger according to claim 1, wherein the housing includes a plurality of chambers.

5. The supercharger according to claim 4, wherein each of the plurality of chambers is overlapping.

6. The supercharger according to claim 1, wherein the rotor is lobed.

7. The supercharger according to claim 1, further comprising an input shaft configured to provide torque to the rotor.

8. The supercharger according to claim 1, wherein the outlet port includes a port end surface and a pair of oppositely disposed port side surfaces.

9. The supercharger according to claim 8, wherein the port end surface is substantially perpendicular to the longitudinal axis.

10. The supercharger according to claim 8, wherein the port end surface is not substantially perpendicular to the longitudinal axis.

11. The supercharger according to claim 1, wherein the front edge is configured to substantially correspond to the shape of the rotor.

12. The supercharger according to claim 1, wherein each of the chamber side surfaces includes a curved portion.

13. The supercharger according to claim 1, wherein the relief chamber has a depth in the axial direction that is equal to about 10% to about 35% of the axial length of the rotor.

14. The supercharger according to claim 1, wherein the relief chamber has a width that is equal to at least about 50% of the width of the chamber in which the rotor is disposed.

15. The supercharger according to claim 1, wherein the isentropic efficiency of the supercharger is at least about 70% at supercharger speeds of at least about 18000 RPM.

16. The supercharger according to claim 1, wherein the isentropic efficiency of the supercharger at about 18000 RPM is at least about 95% of the isentropic efficiency of the supercharger at about 10000 RPM.

* * * * *